US006941984B2

(12) United States Patent
Knight

(10) Patent No.: US 6,941,984 B2
(45) Date of Patent: Sep. 13, 2005

(54) LOW SURFACE ENERGY DRIPLESS FUEL SPOUT

(75) Inventor: Paul A. Knight, Spokane, WA (US)

(73) Assignee: Knubox Technologies, Spokane, WA (US)

( * ) Notice: Subject to any disclaimer, the term of this patent is extended or adjusted under 35 U.S.C. 154(b) by 0 days.

(21) Appl. No.: 10/872,840

(22) Filed: Jun. 21, 2004

(65) Prior Publication Data

US 2005/0087258 A1 Apr. 28, 2005

Related U.S. Application Data

(63) Continuation-in-part of application No. 10/693,183, filed on Oct. 24, 2003, now Pat. No. 6,854,491.

(51) Int. Cl.[7] ..... B65B 1/04
(52) U.S. Cl. ..... 141/206; 141/311 A; 141/392
(58) Field of Search ..... 141/59, 206–211, 141/392, 311 A; 222/108; 239/104

(56) References Cited

U.S. PATENT DOCUMENTS 5,377,729 A * 1/1995 Reep ..... 141/392
5,603,364 A * 2/1997 Kerssies ..... 141/392
5,620,032 A * 4/1997 Dame ..... 141/311 A
5,645,116 A * 7/1997 McDonald ..... 141/208
6,810,920 B1 * 11/2004 Rolling ..... 141/1

* cited by examiner

*Primary Examiner*—Steven O. Douglas
(74) *Attorney, Agent, or Firm*—Knubox Technologies; Paul A. Knight

(57) ABSTRACT

A tubular spout is fluidly connected to a nozzle body. The nozzle body having a main valve for regulating the flow of a supply of fuel to the spout. Within the tubular spout is a dripless valve that moves to an open position allowing for the flow of fuel out the spout and to a closed position shutting off the flow of fuel out of the spout. According to the present invention at least a portion of the dripless valve surface has a surface energy less than the surface tension of the fuel being dispensed.

12 Claims, 5 Drawing Sheets

LOW SURFACE ENERGY DRIPLESS FUEL SPOUT

CROSS REFERENCE TO RELATED APPLICATION

The present invention is a continuation-in-part of U.S. patent application Ser. No. 10/693,183 filed Oct. 24, 2003 entitled "Low Surface Energy Fuel Nozzle". The Ser. No. 10/693,183 patent application issued to U.S. Pat. No. 6,854,491 on Feb. 15, 2005 and is incorporated herein by reference.

STATEMENT REGARDING FEDERALLY SPONSORED R&D

Not applicable to this application.

TECHNICAL FIELD

This invention relates to a fuel nozzle and more particularly to a fuel dispensing nozzle that reduces the amount of fuel that drips from the nozzle spout after an operating cycle.

BACKGROUND OF THE INVENTION

Fuel dispensing nozzles are widely used and understood in the field. Early fuel nozzles are mainly comprised of a manual actuated valve and a metallic spout for directing fuel into a desired container. Many improvements have been made to fuel nozzles, including U.S. Pat. No. 4,453,578, which provide the means of automatically stopping fuel flow when the fuel reaches a desired level.

In addition, many design improvements have been made regarding nozzle spouts. U.S. Pat. No. 5,765,609 describes a method for manufacturing an aluminum spout that removably attaches to a nozzle body. Removable spouts enable them be replaced in shorter intervals than the more expensive nozzle body. Replacing a spout may be desirable when a nozzle is left in a motor vehicle after drive-away, upon considerable wear, or as improved spouts become available.

Recently, significant attention has been directed to the adverse environmental effects caused by fuel dispensing nozzles. One such effect is caused by fuel vapors displaced from a container as heavier liquid fuel is dispensed into the container. The displaced vapors contain volatile organics that chemically react with nitrogen oxides to form ground level ozone, often called "smog". Ground level ozone can potentially cause irritation to the nose, throat, lungs and bring on asthma attacks. In addition, gasoline vapors are suspected to contain other harmful toxic chemicals, such as benzene.

In an effort to reduce the amount of harmful vapors that reach the atmosphere, a vapor recovery nozzle has been developed; one version of the spout is best described by U.S. Pat. No. 4,351,375. This version of a vapor recovery nozzle is comprised of a coaxial tube that both dispense fuel through a main tube and vacuum vapors through a secondary channel. A large percentage of the captured vapors are treated and safely released into the atmosphere. Vapor recovery systems are required by the laws of many states, especially at high volume stations or stations located in densely populated areas. California's Air Resource Board (CARB) is largely responsible for setting forth new standards for fuel dispensing nozzles.

Although vapor recovery has significantly reduced the amount of volatile organics that reach the atmosphere during fueling, there are several other sources of fuel vapors that contribute to the problem of "smog". One such source is fuel dripped from a nozzle spout after fueling. Typically, when a nozzle is deactivated there is a delay before the user removes the nozzle spout from the container to be filled. If the delay is sufficient, drops from the spout will fall into the container. If the delay is insufficient, drops fall onto the ground or the local filling equipment. Spilt fuel evaporates into the atmosphere and contaminates the ground. Even waiting a significant amount of time before removing the nozzle will not ensure that dripping will not occur. Some users try to supplement waiting by tapping the nozzle spout on the fill tube of the container prior to removing it.

In an effort to further reduce sources of "smog" many new nozzle requirements and laws have been implemented. One such requirement is for fuel nozzles to be dripless. The goal is to have zero drops fall from a nozzle spout after the flow has stopped and a reasonable amount of time has elapsed. Many new nozzle designs are directed towards the goal of dripless, such as U.S. Pat. No. 6,520,222, U.S. Pat. No. 5,603,364, U.S. Pat. No. 4,213,488, U.S. Pat. No. 5,645,116, and U.S. Pat. No. 5,620,032. Although the aforementioned patents may potentially serve in the direction of their intended purposes, most are unlikely to reliably provide true dripless performance. Many proposed dripless nozzles continue to drip fuel long after the period of time it takes for a user to remove a spout from a tank.

In these respects, the low surface energy dripless fuel dispensing nozzle spout according to the present invention substantially departs from conventional concepts of the prior art, and in doing so provides an apparatus primarily designed for the purpose of reducing the amount of vapor that reaches the atmosphere during a fueling cycle.

SUMMARY OF THE INVENTION

The present invention therefore aims at providing a nozzle spout that reduces the amount of fuel that drips after the flow of fuel has stopped. A generally tubular spout is fluidly connected to a nozzle body. The nozzle body having a main valve for regulating the flow of a supply of fuel to the spout. Within the tubular spout is a dripless valve that moves from an open position allowing for the flow of fuel out the spout and to a closed position shutting off the flow of fuel out of the spout. According to the present invention, at least a portion of the dripless valve surfaces have low surface energies. The low surface energies may be applied by a coating, a spray or from the base material. A portion of the inside spout surface may also have a low surface energy. Low surface energies cause fuel to bead up rather than wet out and create thin films. Beaded fuel is more easily and reliably controlled by the dripless valve than thin fuel films created by wet out conditions. The result is a nozzle assembly that does not allow drops to fall soon after the flow of fuel has stopped.

These and other features, aspects, and advantages of the present invention will become better understood with regard to the following description, appended claims, and accompanying drawings.

BRIEF DESCRIPTION OF THE DRAWINGS

Preferred embodiments of the invention are described below with the reference to the following accompanying drawings.

DETAILED DESCRIPTION OF THE PREFERRED EMBODIMENTS

Many of the fastening, connection, manufacturing and other means and components utilized in this invention are widely known and used in the field of the invention are described, and their exact nature or type is not necessary for a person of ordinary skill in the art or science to understand the invention; therefore they will not be discussed in detail.

Applicant hereby incorporates by reference the following U.S. patents: U.S. Pat. No. 5,765,609; U.S. Pat. No. 5,603,364; U.S. Pat. No. 4,453,578 and U.S. Pat. No. 5,213,142.

Figure 1:
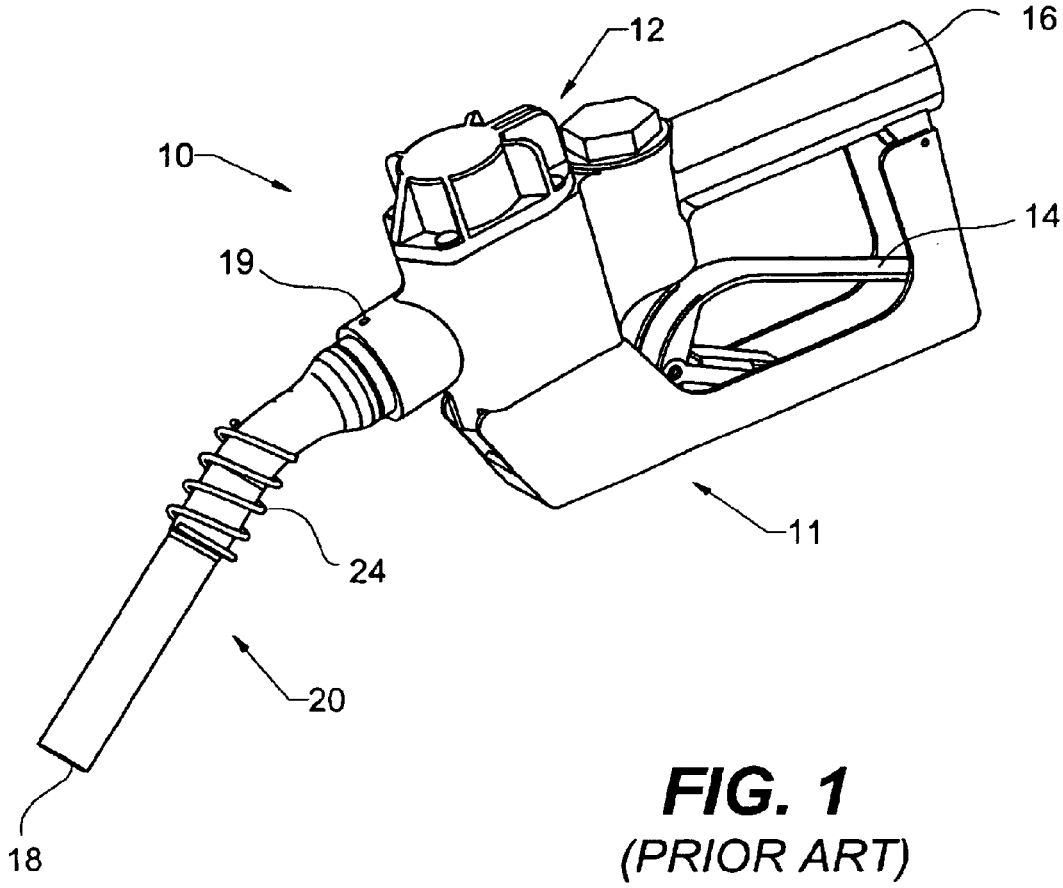
FIG. 1 (PRIOR ART)
FIG. 1 is a perspective view of a prior art standard nozzle assembly.

Referring now to the drawings, FIG. 1 shows a prior art fuel dispensing nozzle assembly 10. The nozzle assembly 10 may be used for dispensing a fuel such as, but not limited to, gasoline or diesel. Typically, nozzle assembly 10 is comprised of a nozzle body 11 which houses the components necessary for safely regulating the flow of fuel. Fuel travels from a fuel supply via a pump and hose system (not shown) to a nozzle inlet end 16, through a valve assembly 12, into a spout 20, and out a discharge end 18. Fuel flow is initiated by a user moving an actuator 14. Fuel flow typically stops due to either the user releasing actuator 14 or by valve assembly 12 sensing a full condition and automatically releasing actuator 14. Detailed descriptions of above components are described by U.S. Pat. No. 4,453,578 but are not necessary for one skilled in the art to understand and appreciate the present invention, thus they will not be discussed in further detail.

Figure 2:
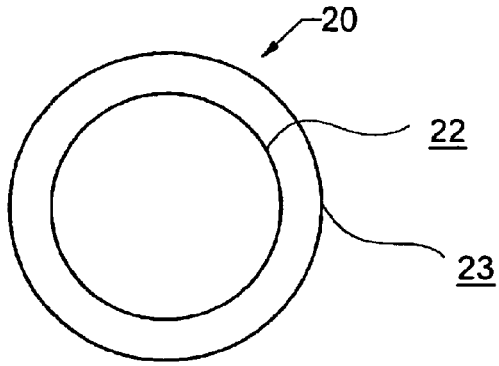
FIG. 2 (PRIOR ART)
FIG. 2 is an end view of a prior art spout.

In many fuel nozzles, spout 20 is removably attached to nozzle body 11. Spout 20 is inserted into nozzle body 11 and the assembly is secured by means of a spout screw 19 (only hole shown). Spout 20 is sealed through the use of one or more o-rings (not shown). As shown in FIG. 2, spout 20 has an inside direct contact surface 22 and an outside indirect contact surface 23. Direct contact surface 22 directs the flow of fuel from nozzle body 11 down the length of spout 20 and into the container to be filled. The length of travel from nozzle body 11 to discharge end 18 is roughly 9 inches. When spout 20 is inserted into the container to be filled, about 3.5 inches of its length (starting from end 18) is within the container. Spring 24 is placed onto spout 20 to keep the spout from being over inserted. Because spout 20 is inserted substantially within the container to be filled, not only does direct contact surface 22 wet with fuel, but indirect contact surface 23 becomes wet due to splashing within the container.

As described by U.S. Pat. No. 5,765,609, a 6005-T5 aluminum material is viewed as an ideal choice for high volume spout production. It can be extruded, turned on a lathe, punched, bent, drilled and formed. In addition, aluminum is lightweight, relatively inexpensive compared to other lightweight materials, and provides the required rigidity and strength. Aluminum, and aluminum allows, are typically inert to the fuels they dispense and are electrically conductive. It can be easily appreciated why aluminum and aluminum alloys constitutes all, or nearly all, spouts in use today.

Dripless features currently being used and tested may often be made from either aluminum or a plastic material, such as nylon or ABS. Plastic is easily moldable and can be made from fuel resistant materials. Dripless features made from plastics do not add significant weight over that of standard nozzles.

A significant drawback to the use of aluminum and plastics in spouts, and the direction of the present invention, is that these types of materials causes unnecessary fuel dripping and liquid retention.

Figure 3:
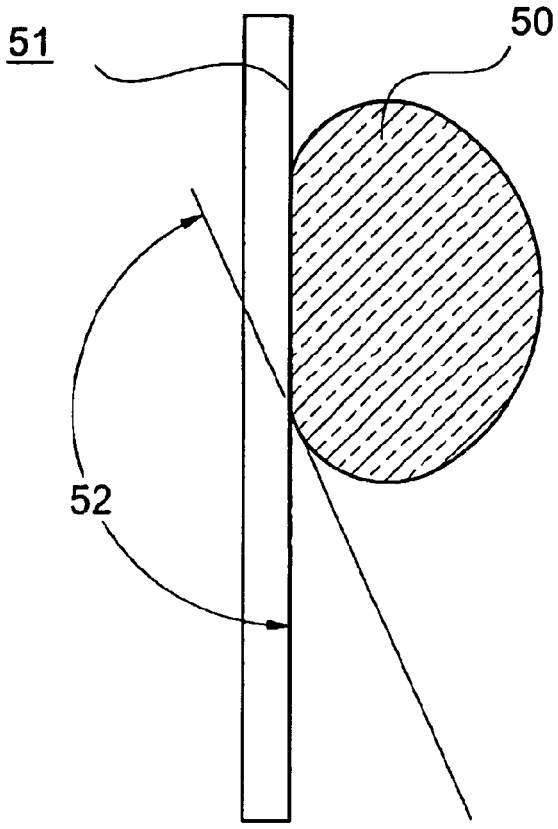
FIG. 3 is a side view of a drop of fuel on a surface having a low surface energy according to the present invention.

The interaction of a liquid droplet and a surface is subject to physical laws and formulas. When a drop is placed onto a surface it can either wet-out into a very thin dispersed film, or it can bead up on the surface. The determination on whether a drop will wet-out or bead up is a function of the relative difference between the surface tension of the liquid in the drop, and the surface energy of the surface on which the drop is placed. A typical bead is shown in FIG. 3, wherein a drop 50 is in direct contact with a low surface energy surface 51. Contact angle 52 provides indication at the degree in which drop 50 is in contact with surface 51. Contact angle 52 can be predicted by Young's Equation which states the solid-vapor interfacial tension minus the solid-liquid interfacial tension equals the liquid-vapor interfacial tension multiplied by the cosine of critical angle 52.

In the case of aluminum spouts used for dispensing fuel, aluminum has a much higher surface energy than the surface tension of gasoline or diesel. Aluminum typically has a surface energy close to 45 dynes per centimeter and gasoline has a surface tension close to 21.6 dynes per centimeter. Diesel has a larger surface tension than gasoline at roughly 30 dynes per centimeter. Thus, it can be appreciated that aluminum spouts are easily wet-out by either gasoline or diesel.

Figure 4:
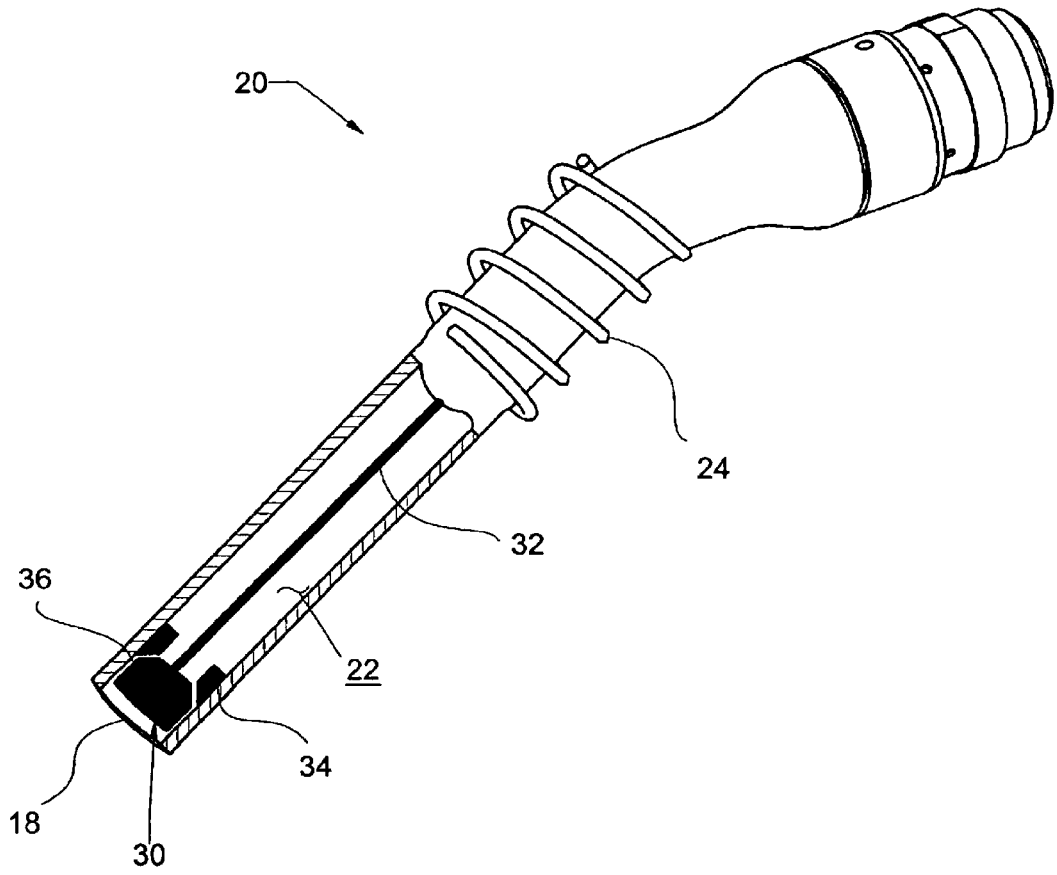
FIG. 4 is a perspective view of a nozzle spout with a cutaway to show the inside low surface energy surfaces of a dripless assembly.

FIG. 4 shows the preferred embodiment of the present invention. A dripless valve assembly 30 is located adjacent to discharge end 18. A wire 32 is attached to valve system 12, or actuator 14, and to a plunger 36. Plunger 36 is pulled against a seat 34 wherein the interaction of seat 34 and plunger 36 discourages residual fuel within spout 20 from reaching discharge end 18. Seat 34 may be a member attached to spout surface 22 or manufactured integral thereto. According to the present invention, at least the contact surfaces of plunger 36 and seat 34 are low surface energy surfaces and provide the means of reducing post fueling dripping from spout 20. Rather than have fuel wick between plunger 36 and seat 34, as is the case with the prior art, the low surface energies of the contact surfaces between plunger 36 and seat 34 discourages fuel from wicking between them. Depending upon the magnitude of the difference in surface energies of the contact surfaces and the surface tension of the fuel used, one or more beads of fuel are likely to form at the junction of plunger 36 and seat 34. With plunger 36 in the closed position, any liquid located at the discharge end 18 is fluidly disconnected from any fuel upstream of plunger 36. As described by U.S. patent application Ser. No. 10/693,183, nozzles can be made more dripless by surfaces having low surface energies, and residual fuel amounts can be reduced by the spout surfaces having low surface energies. Reducing residual fuels is favorable to reducing dripping.

A low surface energy perfluroalkoxy (PFA) coating has been tested with gasoline and diesel fuel and shown to create non-wetting conditions. PFA, a member of the Teflon family (a trademark of DuPont) is commercially available and can be easily sprayed onto surfaces. Even though a thin PFA coating has been disclosed as the best mode of the present invention, it is not limited to such and the present invention should not be construed to be limited to a fluorocarbon, a fluoropolymer, or a Teflon coating (trademark of Dupont). Other materials may be applied, or used, to provide low surface energy surfaces. This includes materials which may be deposited by CVD, dipped, sprayed, and electro-statically deposited. In addition, the spout may be manufactured from a material that has a low surface energy, such as from a molding process for example. All fall within the spirit of the present invention.

Figure 5:
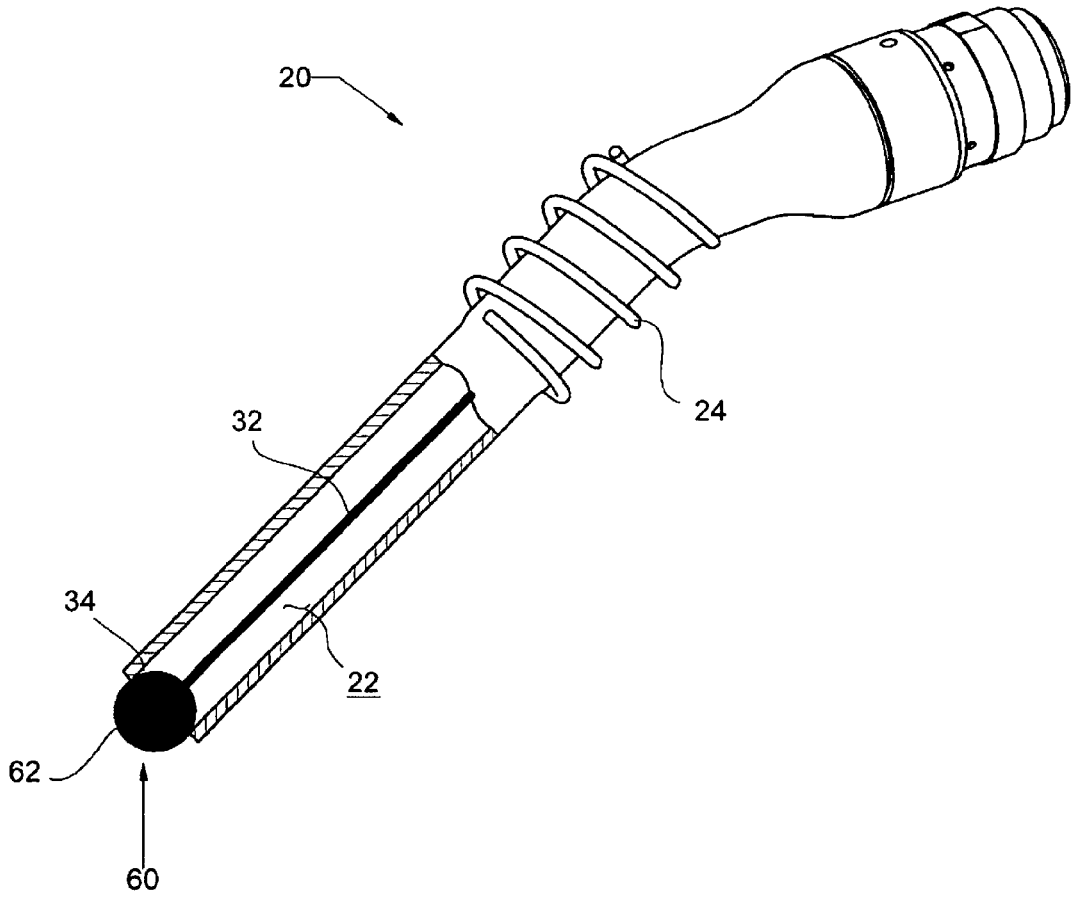
FIG. 5 is a partial side section view of an alternative embodiment of the present invention with a generally spherical shaped plunger.

It should be appreciated that the present invention is not limited to the shape of plunger 36 shown in FIG. 4. Other shapes, such as spheres, may be used and an example is shown by a spherical dripless assembly 60 of FIG. 5. Spherical dripless assembly 60 includes a sphere 62 which may provide favorable flow out of discharge end 18 when in the open position. Spherical dripless assembly 60 shows seat 34 integral to inside contact surface 22. This version of seat 34 may be created by only coating the end portion of surface 22.

Figure 6:
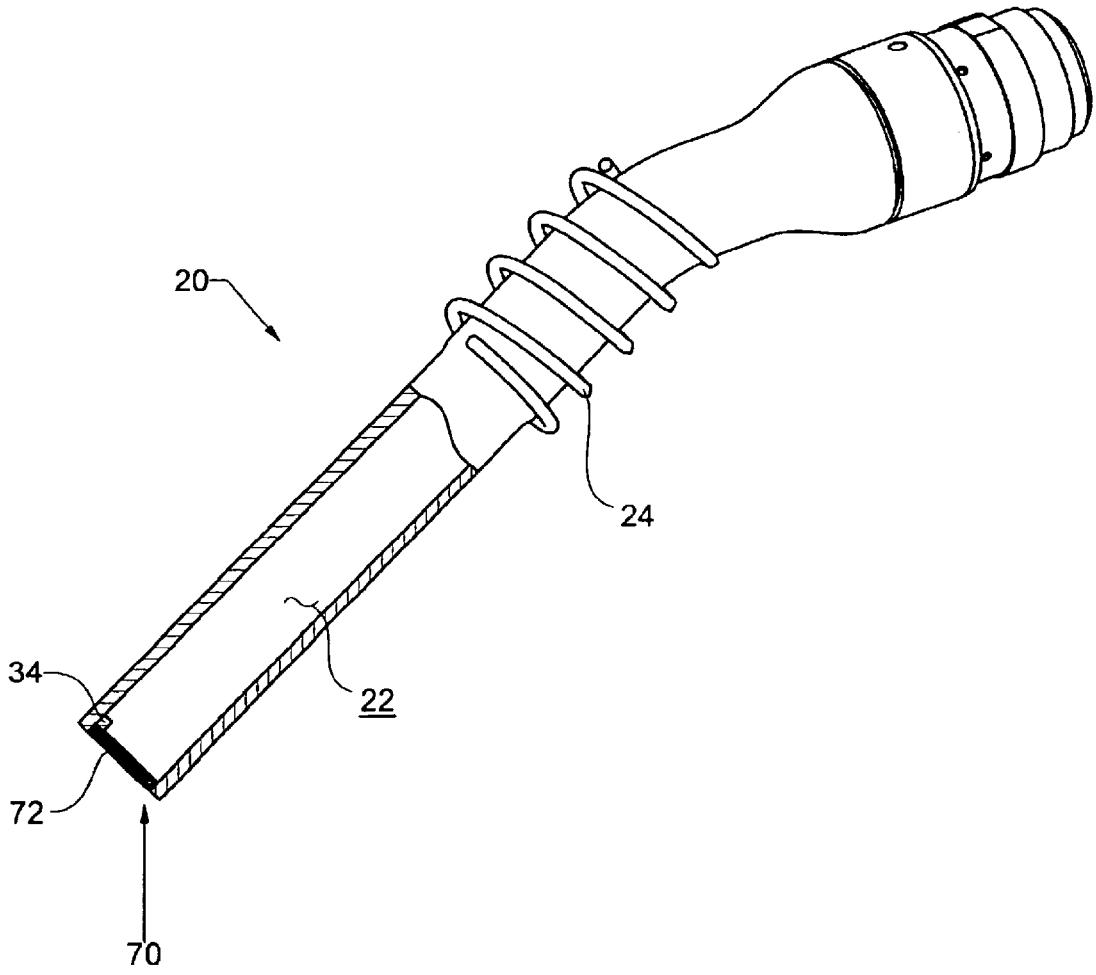
FIG. 6 is a partial side section view of another alternative embodiment of the present invention having a flapper dripless valve.

FIG. 6 shows another alternative embodiment of the present invention having a flapper dripless valve assembly 70. Rather than use a plunger, a low surface energy flapper valve 72 may be attached to spout 20. Flapper valve 72 can flex or rotate to an open position and then return to a closed position in contact with seat 34. Upon closing, flapper valve 62 may provide a seal similar to that of a plunger 36 of the preferred embodiment.

The present invention is used in a similar fashion to existing dripless nozzles. The user starts the flow of fuel by moving actuator 14. Dripless valve assembly 30 moves from the closed position to the open position, thus allowing for the flow of fuel out discharge end 18. After the user stops the flow of fuel, or the nozzle senses a full condition, plunger 36 moves to the close position and against seat 34. The interaction of plunger 36 and seat 34 discourage further flow of fuel to discharge end 18.

While the dripless nozzle systems herein described constitute preferred embodiments of the invention, it is to be understood that the invention is not limited to these precise form of assemblies, and that changes may be made therein without departing from the scope and sprit of the invention as defined in the appended claims.

What is claimed is:

1. A fuel dispensing spout comprising:

an inside spout surface for directing the flow of a supply of fuel from an inlet end to a discharge end;

said inside spout surface having a seat surface in close proximity to said discharge end;

a plunger capable of moving from an open position allowing for the flow of said fuel out said discharge end, and to a closed position wherein said plunger is in contact with said seat surface;

wherein at least a portion of said plunger has a surface energy less than the surface tension of said fuel; and wherein said seat surface has a surface energy less than the surface tension of said fuel.

2. The fuel dispensing spout of claim 1, wherein said seat surface is made from a material of the fluoropolymer family.

3. The fuel dispensing spout of claim 1, wherein said portion of said plunger is made from a material of the fluoropolymer family.

4. The fuel dispensing spout of claim 1, wherein said surface tension of said supply of fuel is less than 30 dynes per centimeter.

5. A fuel dispensing spout system comprising:

an inside spout surface for directing the flow of a supply of fuel from an inlet end to a discharge end;

said inside spout surface having a seat surface in close proximity to said discharge end;

a flap capable of moving from an open position allowing for the flow of said fuel out said discharge end, and to a closed position wherein said flap is in contact with said seat surface;

wherein at least a portion of said flap has a surface energy less than the surface tension of said fuel; and wherein said seat surface has a surface energy less than the surface tension of said fuel.

6. The fuel dispensing spout of claim 5, wherein said portion of said flap is made from a material of the fluoropolymer family.

7. The fuel dispensing spout of claim 5, wherein said seat surface is made from a material of the fluoropolymer family.

8. The fuel dispensing spout of claim 5, wherein said surface tension of said supply of fuel is less than 30 dynes per centimeter.

9. A fuel dispensing nozzle system comprising:

a generally tubular spout for directing a supply of fuel from a receiving end to a discharge end;

a dripless system attached to said spout; and, wherein said dripless system has one or more surfaces capable of creating a non-welling condition with said supply of fuel.

10. The fuel dispensing nozzle system of claim 9, wherein said dripless system includes a flapper valve.

11. The fuel dispensing nozzle system of claim 9, wherein said dripless system includes a plunger.

12. The fuel dispensing nozzle system of claim 9, wherein said one or more surfaces is made from a material of the fluoropolymer family.

* * * * *